US008833879B2

(12) United States Patent
Netzer

(10) Patent No.: US 8,833,879 B2
(45) Date of Patent: Sep. 16, 2014

(54) FIXING DEVICE FOR A FURNITURE PART

(71) Applicant: Julius Blum GmbH, Hochst (AT)

(72) Inventor: Emanuel Netzer, Hochst (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/897,753

(22) Filed: May 20, 2013

(65) Prior Publication Data

US 2013/0249368 A1 Sep. 26, 2013

Related U.S. Application Data

(63) Continuation of application No. PCT/AT2011/000470, filed on Nov. 18, 2011.

(30) Foreign Application Priority Data

Nov. 23, 2010 (AT) ..... 1943/2010

(51) Int. Cl.
*A47B 88/04* (2006.01)

(52) U.S. Cl.
CPC ..... *A47B 88/0418* (2013.01); *A47B 88/04* (2013.01)
USPC ..... 312/333; 312/334.1

(58) Field of Classification Search
USPC ..... 312/330.1, 331, 333, 334.1, 334.8
See application file for complete search history.

(56) References Cited

U.S. PATENT DOCUMENTS

| | | | | |
|---|---|---|---|---|
| 5,632,541 | A | 5/1997 | Uthoff | |
| 6,629,738 | B2 * | 10/2003 | Salice | 312/333 |
| 7,384,108 | B2 * | 6/2008 | Lam et al. | 312/334.44 |
| 7,654,625 | B2 | 2/2010 | Amann et al. | |
| 7,708,358 | B2 * | 5/2010 | Embacher | 312/333 |
| 7,980,640 | B2 * | 7/2011 | Yang | 312/333 |
| 8,424,984 | B2 * | 4/2013 | Ritter | 312/333 |
| 8,511,763 | B2 * | 8/2013 | Salice | 312/333 |
| 2002/0033658 | A1 | 3/2002 | Salice | |
| 2006/0186772 | A1 | 8/2006 | Lam et al. | |
| 2007/0046159 | A1 | 3/2007 | Hoffman | |
| 2009/0273263 | A1 * | 11/2009 | Berger | 312/334.1 |
| 2011/0115353 | A1 * | 5/2011 | Domenig et al. | 312/333 |
| 2013/0076218 | A1 * | 3/2013 | Radusin | 312/319.1 |

FOREIGN PATENT DOCUMENTS

| | | |
|---|---|---|
| AT | 007 648 | 7/2005 |
| DE | 93 10 582 | 9/1993 |
| DE | 202 04 724 | 5/2002 |
| EP | 1 188 397 | 3/2002 |
| EP | 1 479 319 | 11/2004 |
| EP | 1 692 969 | 8/2006 |
| EP | 1 785 061 | 5/2007 |
| EP | 2 208 439 | 7/2010 |
| WO | 2010/011822 | 1/2010 |

OTHER PUBLICATIONS

International Search Report (ISR) issued Jan. 26, 2012 in International (PCT) Application No. PCT/AT2011/000470.
Austrian Patent Office Search Report (ASR) completed Jun. 10, 2011 in Austrian Patent Application No. A 1943/2010.

* cited by examiner

*Primary Examiner* — Daniel Rohrhoff
(74) *Attorney, Agent, or Firm* — Wenderoth, Lind & Ponack, L.L.P.

(57) ABSTRACT

A device attaches a functional unit to a rail of a drawer pull-out guide. The device has at least one coupling element so that at least two different functional units can be selectively fixed to the drawer pull-out guide.

15 Claims, 14 Drawing Sheets

FIXING DEVICE FOR A FURNITURE PART

BACKGROUND OF THE INVENTION

The invention concerns a drawer extension guide and an article of furniture having such a drawer extension guide. The invention further concerns a set comprising at least two functional units.

Drawer extension guides of that kind are already known in large numbers from the state of the art.

The object of the invention is to provide an improved drawer extension guide.

SUMMARY OF THE INVENTION

According to the invention, the device has at least one coupling element by which at least two different functional units can be selectively fixed to the drawer extension guide.

That makes it possible for two different functional units to be mounted in place by way of one and the same device. As a result, different devices for fixing functional units are not required, but can be done with a single device. That therefore contributes both to reducing the costs in manufacture and also the fact that—if ever a functional unit should be replaced—the device does not also have to be replaced, but the existing device can be used to mount the new functional unit.

It has proven to be particularly advantageous if the functional units can be releasably fixed to the coupling element—preferably without a tool. Because the functional units can be releasably fixed they can be subsequently fitted and also subsequently removed and can thus be easily replaced. It is particularly advantageous in that respect if that can be effected without a tool as that contributes to keeping the assembly time short.

In a preferred embodiment, the coupling element has a latching device. A latching device makes it possible to provide that no additional assembly activities are necessary for fixing a functional unit to the drawer extension guide.

At least one coupling element can be provided on the carcass rail, and at least one further coupling element can be provided on the drawer rail. A further coupling element on the drawer rail provides that a functional unit arranged thereon can move with the drawer rail, whereas the coupling element on the carcass rail can serve as a control for the functional unit, like for example as an on/off switch for the functional unit, as a damping member for an inwardly moving furniture part or also as an abutment member, from which a functional unit in the form of a furniture drive can be pushed off.

It has further proven to be advantageous if the functional units can be fixed by the device to the drawer rail of the drawer extension guide. Thus, the functional units can move with the drawer rail of the drawer extension guide when the drawer is moved out or in.

It has proven to be particularly advantageous if the coupling element is hook-shaped. A hook-shaped configuration permits a functional unit to be quickly mounted to the drawer extension guide by way of the coupling element of the device.

Preferably, the device can be in the form of a structural unit independent of the drawer extension guide. Making the device in the form of an independent structural unit permits subsequent fitment of the device to a drawer extension guide or to a functional unit and can thus make it possible for the device to be subsequently fitted to a drawer extension guide or a functional unit. Thus, it is now possible for subsequent fitment to be effected in relation to an already existing drawer extension guide system, in which case the drawer extension guide does not have to be changed.

In that respect, it has proven to be particularly advantageous if the device is provided at least partially at the underside of the drawer rail and/or at least partially at the side of the drawer rail, that is remote from the carcass of an article of furniture. Arranging the device at the underside of the drawer rail and/or at the side of the drawer rail, that is remote from the carcass, can provide that the free space existing beneath a drawer can be used for the device.

In a preferred embodiment, the functional units can be arranged by the device laterally, substantially parallel to the drawer rail, at the side of the drawer extension guide, that is remote from a furniture carcass. Such a design configuration can again provide that the free space under a drawer can be used for the device.

It has further proven to be advantageous if the functional unit has an ejection device for ejecting a rail of the drawer extension guide from a closed end position into an open position.

It has further proven to be advantageous if the functional unit has a retraction device by which a rail of the drawer extension guide can be pulled towards the end of the closing movement into the completely closed position and/or the functional unit has a damping device for damping a rail movement of the drawer extension guide.

Preferably, the functional units are supported at the coupling element of the device. The support effect can contribute to being able to implement rapid assembly.

It is further proposed that the coupling element of the functional unit is adapted to be movable—preferably spring-loaded.

It has proven to be advantageous if, upon relative movement of the rails relative to each other, the coupling element of the functional unit is coupled at times to the coupling element of the rail and/or bears at times against the coupling element of the rail.

A particularly advantageous structural variant provides that the functional unit is releasably fixed by the device to the drawer rail of the drawer extension guide and moves together with the drawer rail. The coupling element of the functional unit also moves together with the drawer rail, and the coupling element corresponding to the coupling element of the functional unit is unmoved relative to the functional unit.

The variant reversed in relation thereto can equally be provided if the functional unit is releasably fixed by the device to the carcass rail of the drawer extension guide and the coupling element corresponding to the coupling element of the functional unit moves together with the drawer rail.

It has been found to be particularly advantageous if at least two functional units can be fixed simultaneously to the device and/or at least two functional units can be selectively fixed to the device.

In specific terms, an article of furniture having at least one drawer extension guide with a device as described above can also be obtained.

A set can include a first functional unit and at least one second functional unit, wherein selectively the functional units can be fixed by way of the coupling element of the device for mounting a functional unit to a rail as described above.

BRIEF DESCRIPTION OF THE DRAWINGS

Further details and advantages of the present invention are described more fully hereinafter by the specific description with reference to the embodiments by way of example illustrated in the drawing in which.

DETAILED DESCRIPTION OF THE INVENTION

Figure 1A:
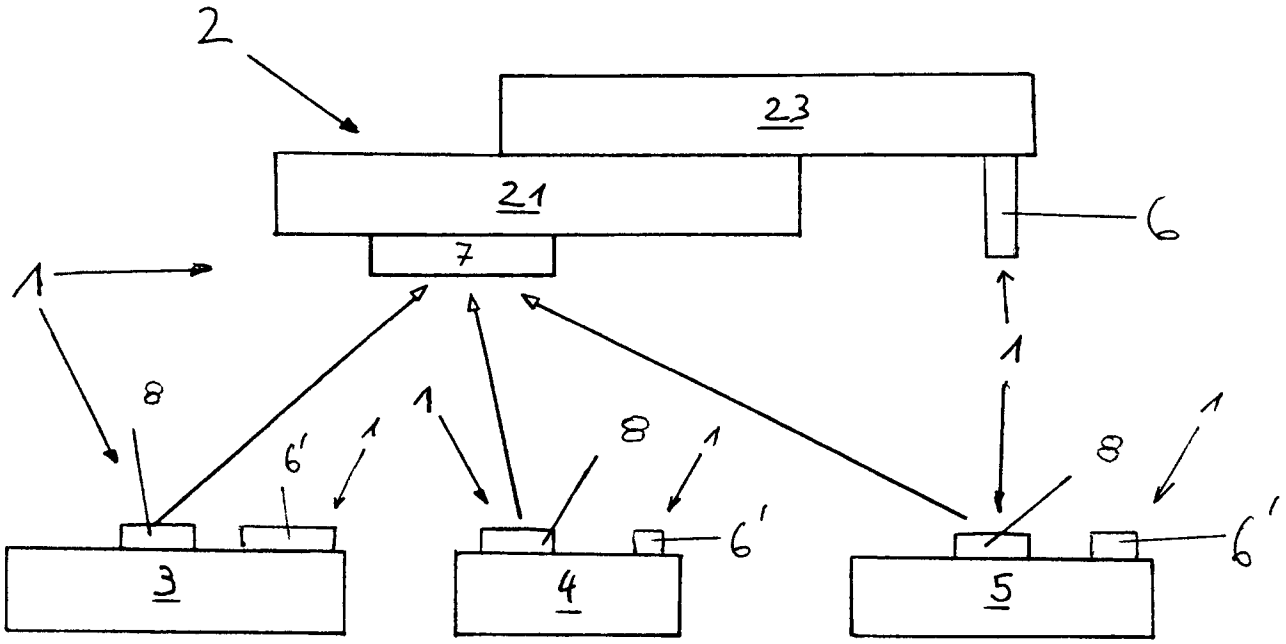
FIG. 1*a* shows a symbolic view of a plurality of functional units which can be mounted to a rail of a drawer extension guide by a device for mounting the functional units.

FIG. 1*a* shows a diagrammatic view of a drawer extension guide 2, the drawer extension guide 2 having two rails 21 and 23, the rail 23 representing a carcass rail and the rail 21 a drawer rail. Arranged on the drawer rail 21 is a coupling element 7 of an attachment device 1 for mounting functional units 3, 4 and 5.

The functional units 3, 4 and 5 also have a coupling element 8 by way of which the functional units 3, 4 and 5 can be selectively fixed to the coupling element 7 of the drawer rail 21. That provides that one and the same drawer extension guide 2 can accommodate different functional units 3, 4 or 5 on the drawer extension guide 2.

The carcass rail 23 also has a coupling element 6 with which the functional units 3, 4 and 5 correspond by way of their coupling elements 6' with the coupling element 6 of the carcass rail 23.

In this preferred embodiment, the drawer extension guide system 2 has a coupling element 7 on the drawer rail 21, by way of which the functional units 3, 4 and 5 can move with the drawer rail 21. On the other hand, the drawer extension guide 2 at its carcass rail 23 has a coupling element 6 which does not move together with the functional units 3, 4 and 5 and the drawer rail 21, respectively.

Figure 1B:
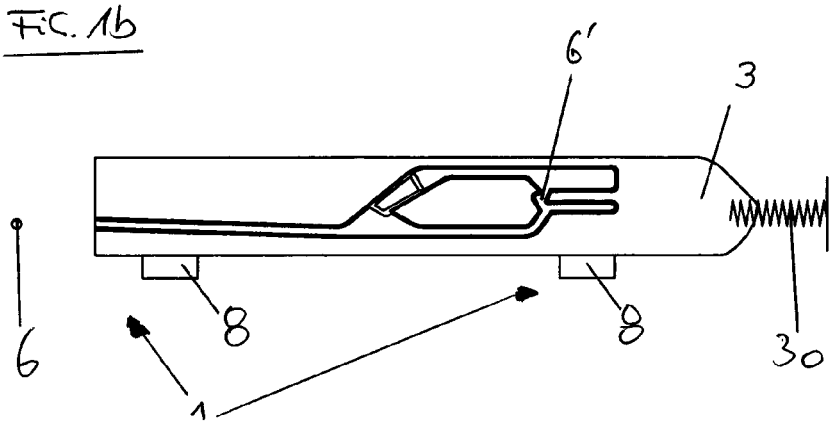
FIG. 1*b* shows a diagrammatic view of a functional unit in the form of an ejection device.

FIG. 1*b* shows a diagrammatic view of a functional unit 3 in the form of an ejection device. That functional unit 3 can be releasably fixed to a drawer extension guide 2 (not shown here) by the coupling elements 8.

In that case, the coupling element 6' corresponds to the coupling element 6. The functional unit 3 can be releasably fixed by the attachment device 1 to the drawer rail 21 (not shown here) of the drawer extension guide 2, and moves together with the drawer rail 21. The coupling element 6' of the functional unit 3 also moves together with the drawer rail 21, and the coupling element 6 corresponding to the coupling element 6' of the functional unit 3 is unmoved relative to the functional unit 3.

If now the functional unit 3 is moved in the direction of the coupling element 6, the coupling element 6 moves in the guide, in the shape of a cardioid curve, in the functional unit 3 until reaching a latching point—the coupling element 6'—which is in the form of a recess in the cardioid curve. In that situation, the functional unit 3 and therewith also the coupling element 6' of the functional unit 3 was prestressed by way of the spring device 30.

If now pressure is again exerted on the functional unit 3, the coupling element 6 moves out of the recess in the cardioid curve of the functional unit 3 and the functional unit 3 and together therewith the drawer rail 21 (not shown here) are ejected.

It will be appreciated that this could also be reversed, wherein the attachment device 1 is releasably connected to the carcass rail 23 (not shown here) of the drawer extension guide 2, while the coupling element 6 corresponding to the coupling element 6' of the functional unit 3 moves together with the drawer rail 21.

Figure 1C:
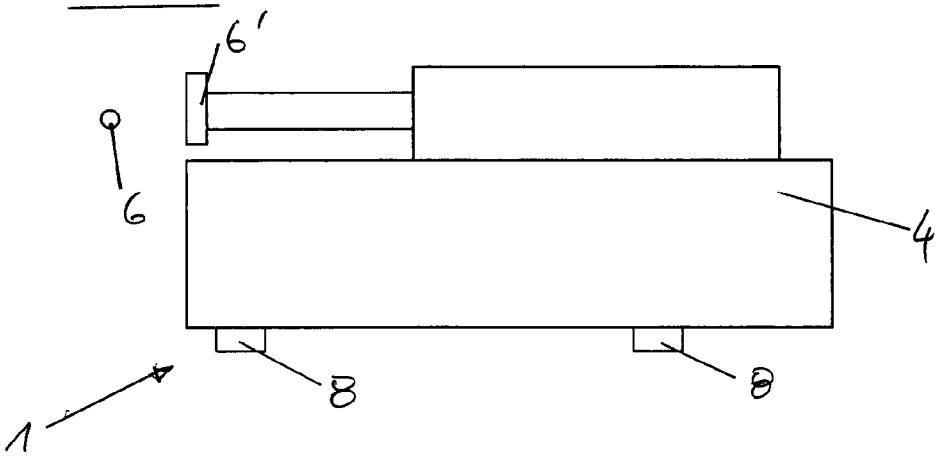
FIG. 1*c* shows a diagrammatic view of a functional unit in the form of a damping device.
Figure 1D:
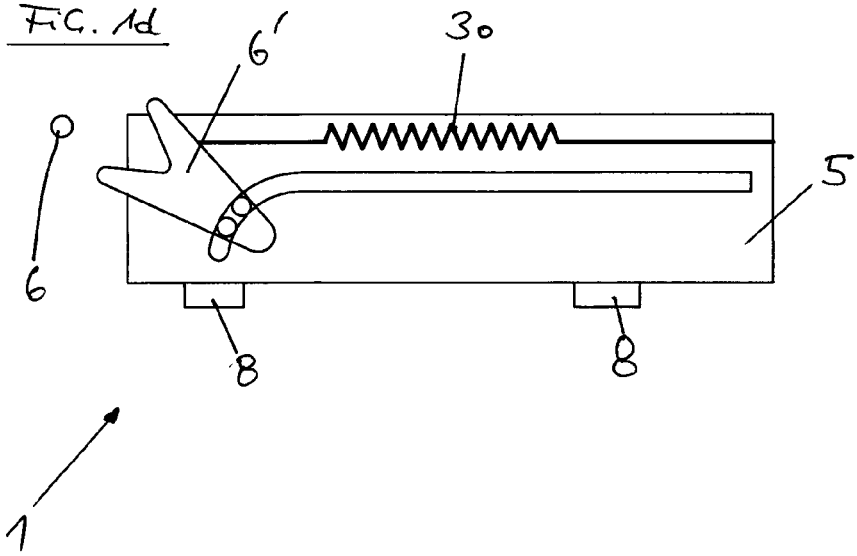
FIG. 1*d* shows a diagrammatic view of a functional unit in the form of a retraction device.

It will be appreciated that this principle also applies to the functional unit 4 shown in FIG. 1*c* in the form of a damping device, and also for the functional unit 5 shown in FIG. 1*d* as a retraction device.

FIG. 1*c* shows the functional unit 4 which in this embodiment is in the form of a damping device having a coupling element 6' which bears at times against the coupling element 6 if the drawer (not shown here) on which the functional unit 4 is disposed on the drawer extension guide 2 (not shown here) is pushed into the furniture carcass. When the coupling element 6' of the functional unit 4 encounters the coupling element 6, the functional unit 4 and therewith also the drawer rail 21 to which the functional unit 4 is connected by way of the coupling elements 8 is braked.

FIG. 1*d* shows a functional unit 5 in the form of a retraction device. At the moment when the movable spring-loaded coupling element 6' of the functional unit 5 encounters the coupling element 6 the functional unit 5 and the drawer rail connected thereto are pulled in by way of the spring device 30.

Therefore, it is the case with all three functional units 3, 4 and 5 as shown in FIGS. 1*b*, 1*c* and 1*d* that, upon a relative movement of the rails 21, 22 and 23 (not shown here) relative to each other, the coupling element 6' of the functional units 3, 4 and 5 is coupled at times to the coupling element 6 and the rails 21, 22 and 23, and/or bears at times against the coupling element 6 of the rail 21, 22 or 23.

It will be appreciated that it is also possible to envisage the coupling element 6 being provided in a furniture carcass (not shown here) and not at one of the rails 21, 22 or 23.

Figure 2:
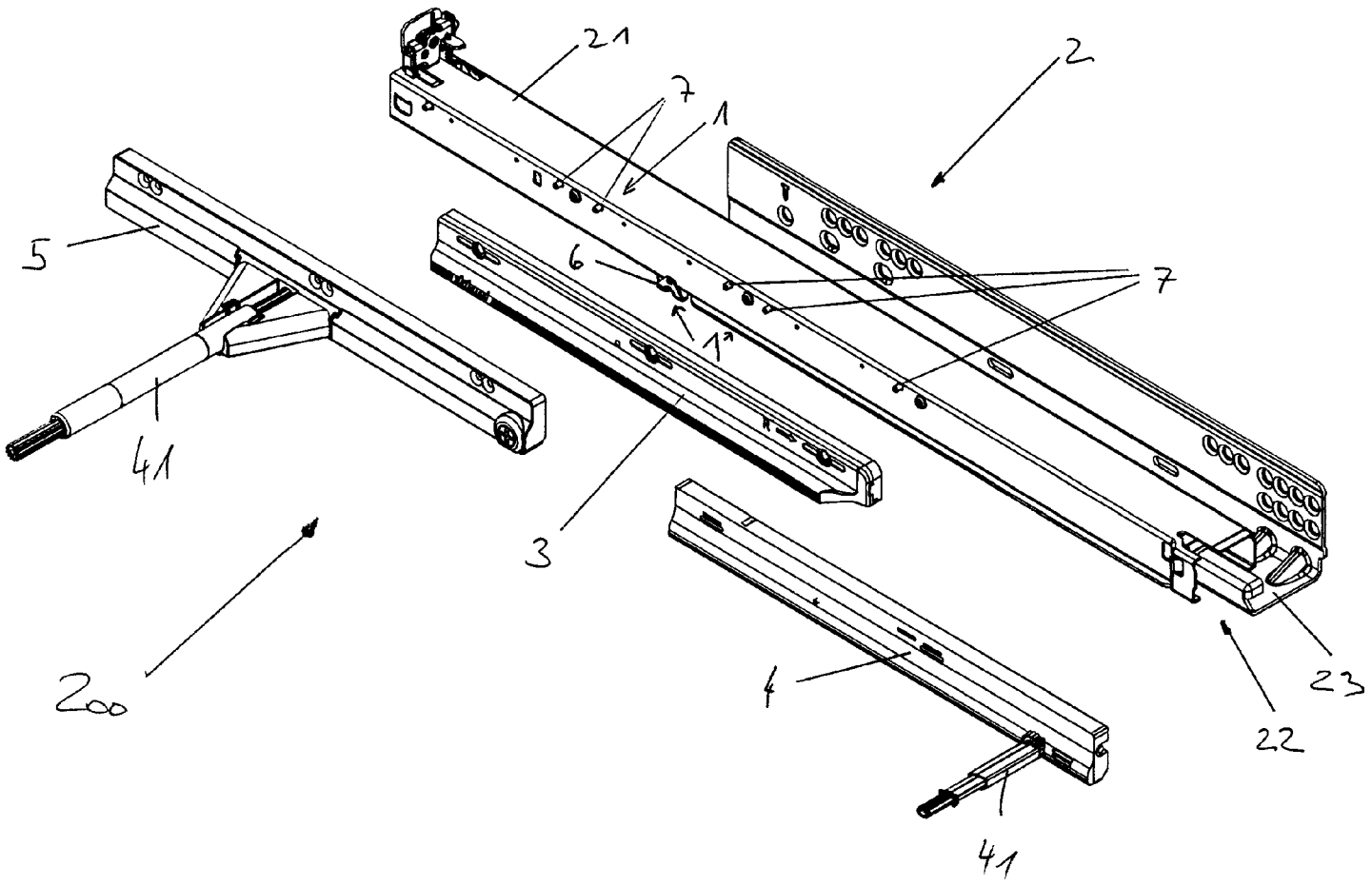
FIG. 2 shows a perspective view of a drawer extension guide and three functional units which can be mounted to that drawer extension guide.

FIG. 2 shows a perspective view of a drawer extension guide 2 and three functional units 3, 4 and 5 which can be mounted thereto. Those different functional units 3, 4 and 5 can be fixed selectively by the coupling elements 7 of the attachment device 1 to the drawer rail 21 of the drawer extension guide 2. In addition, in this preferred embodiment, the functional units 3 and 5 can also both be mounted at the same time (simultaneously) to the drawer rail 21 of the drawer extension guide 2.

In this case the functional units 3, 4 and 5 can preferably be fixed to the coupling elements 7 without a tool.

In addition, in this preferred embodiment, the drawer extension guide 2 has the coupling element 6 of the attachment device 1 at its carcass rail 23. The functional units 3, 4 and 5 are equally fixed to that coupling element 6. That fixing however is only temporary in this preferred embodiment. In other words, when the drawer rail is extended, the functional unit does not enjoy any contact with the coupling element 6. In that case, the coupling element 6 of the carcass rail 23 has a configuration such that it extends under the central rail 22 and the drawer rail 21 and can engage into a guide groove of the functional units 3, 4 and 5.

That is preferably used to provide that, for example, the functional unit 3 can be repelled from that coupling element 6, and thus a drawer (not shown) can be ejected from the article of furniture (not shown).

On the other hand, the coupling element 6 can be used to provide that a damping device (not shown) in one of the functional units provides for damping of the drawer at the coupling element 6. It will be appreciated that the coupling element 6 can also equally be used for the automatic retraction function of the functional units. It will be appreciated that, moreover, it is also possible to envisage a large number of other functions which can be controlled by way of the coupling element 6.

In this arrangement the coupling element 6 is hook-shaped, whereby the functional units 3, 4 and 5 can be supported at the coupling element 6 of the attachment device 1.

In this preferred embodiment, the functional units 3, 4 and 5 belong to a set 200, wherein the functional units 3, 4 and 5 can be selectively fixed to a rail 21 of the drawer extension guide 2 by the attachment device 1 for mounting one of the functional units 3, 4 or 5.

It will be appreciated that it is equally possible to envisage that the functional units 3, 4 or 5 could be fixed not to the drawer rail 21 but to the central rail 22 or to the carcass rail 23 by way of a device 1.

In this preferred embodiment, the attachment device 1 is provided at least partially beneath the drawer rail 21 and also partially at the side of the drawer rail 21, that is remote from the carcass 101 (not shown) of an article of furniture 100 (not shown).

That makes it possible for the functional units 3, 4 and 5 to be arranged by the device 1 laterally substantially parallel to the drawer rail 21 at the side of the drawer extension guide 2, that is remote from the furniture carcass 101.

In a particularly preferred embodiment, the attachment device 1 is in the form of an independent (non-integral) structural unit separate from the drawer extension guide 2. That makes it possible, for example, for the attachment device 1 to be subsequently implemented as a retro-fitting unit on an already existing drawer extension guide 2.

A very wide range of different implementations can be envisaged as functions for the functional units 3, 4 and 5. For example, the functional units can have an ejector device for ejecting one of the rails of the drawer extension guide 2 from a closed end position into an open position or, for example, the functional units can have a retraction device by which a rail of the drawer extension guide, towards the end of the closing movement, can be pulled into the completely closed position, and/or the functional units can have a damping device for damping a rail movement of the drawer extension guide 2. It is also possible to envisage the functional units having a synchronization device 41, as is the case for example with the functional units 4 and 5 in this embodiment.

Figure 3:
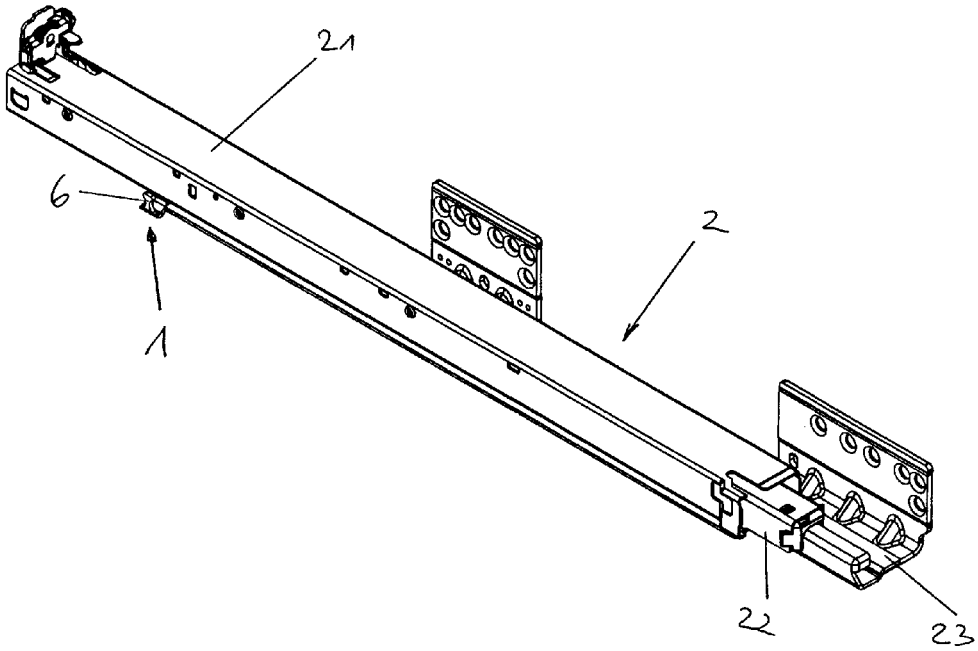
FIG. 3 shows a perspective view of a drawer extension guide with a coupling element.

FIG. 3 shows a perspective view of a drawer extension guide 2 with a drawer rail 21, a central rail 22 and a carcass rail 23. Provided on the carcass rail 23 is a hook-shaped coupling element 6 of the attachment device 1 for receiving the functional units 3, 4 and 5 (not shown here).

Figure 4A:
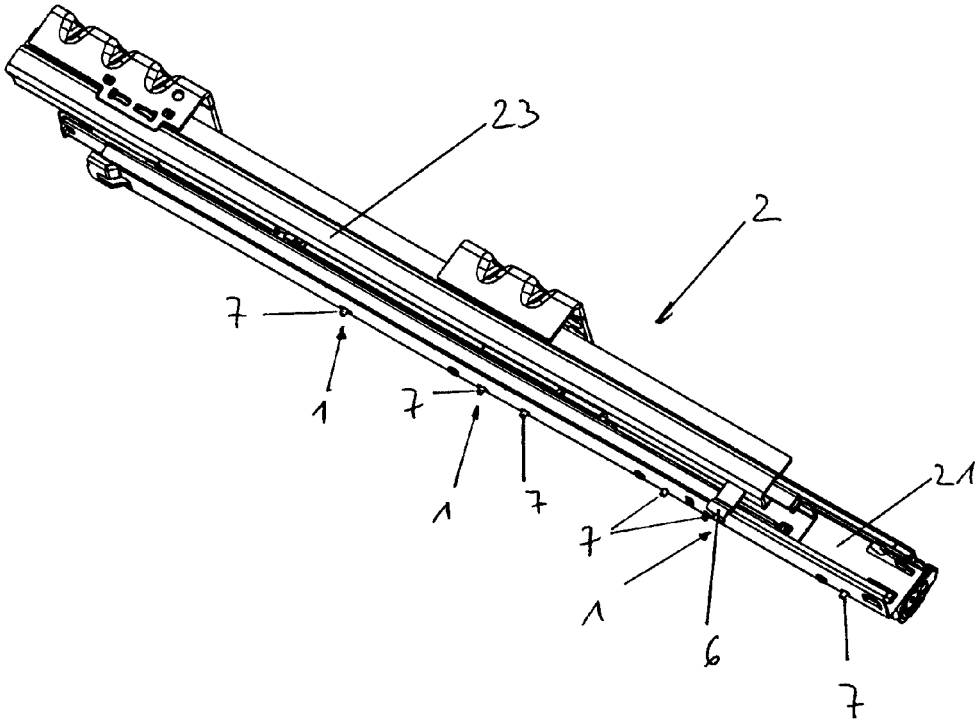
FIG. 4*a* shows a perspective view from below of a drawer extension guide.
Figure 4B:
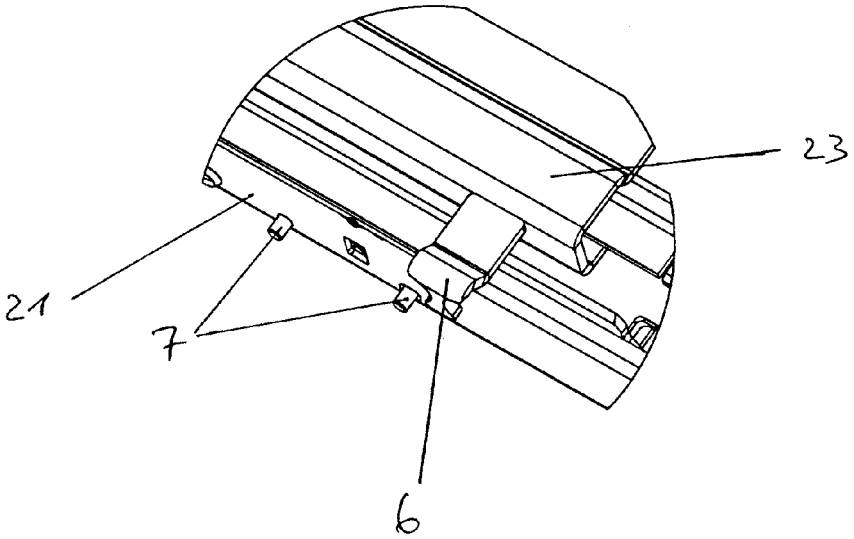
FIG. 4*b* shows a detail view of FIG. 4*a*.

FIG. 4*a* shows a view of the drawer extension guide 2 as shown in FIG. 3, as a perspective view from below. Both FIG. 4*a* and also a detail view from FIG. 4*a*-FIG. 4*b*—show further coupling elements 7 which also serve for receiving and positioning the functional units 3, 4 and 5 (not shown here).

Figure 5A:
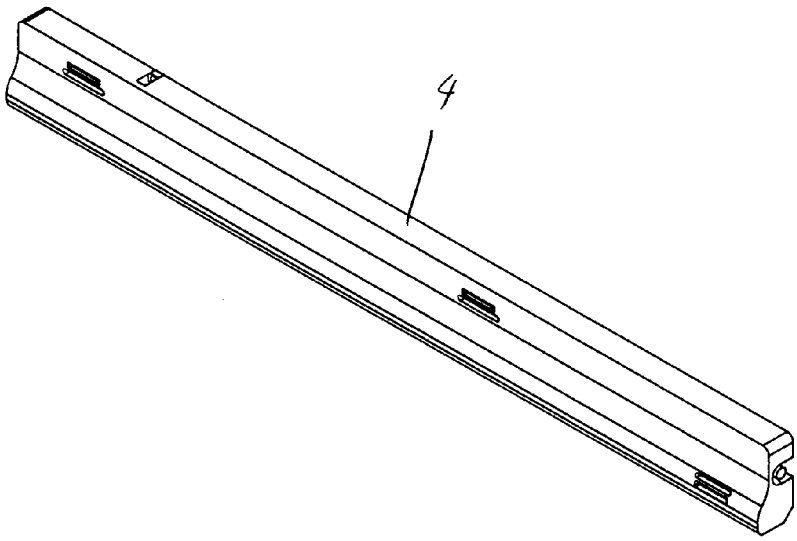
FIG. 5*a* shows a perspective view of a functional unit.
Figure 5B:
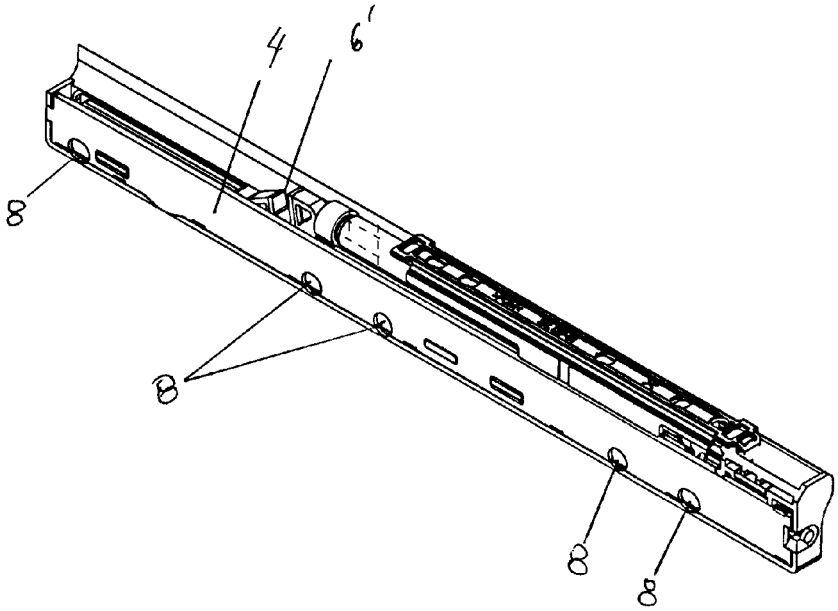
FIG. 5*b* shows a perspective view from below of the functional unit of FIG. 5*a*.

FIG. 5*a* shows a perspective view of a functional unit 4. FIG. 5*b* shows a view from below of the functional unit 4 of FIG. 5*a*. In this respect, it is possible to see the coupling element 6' which corresponds to a coupling element 6 (not shown here) of the drawer extension guide 2 (also not shown).

It is also possible to see further coupling elements 8 which correspond to the coupling elements 7 (see FIG. 4*a*).

Figure 6:
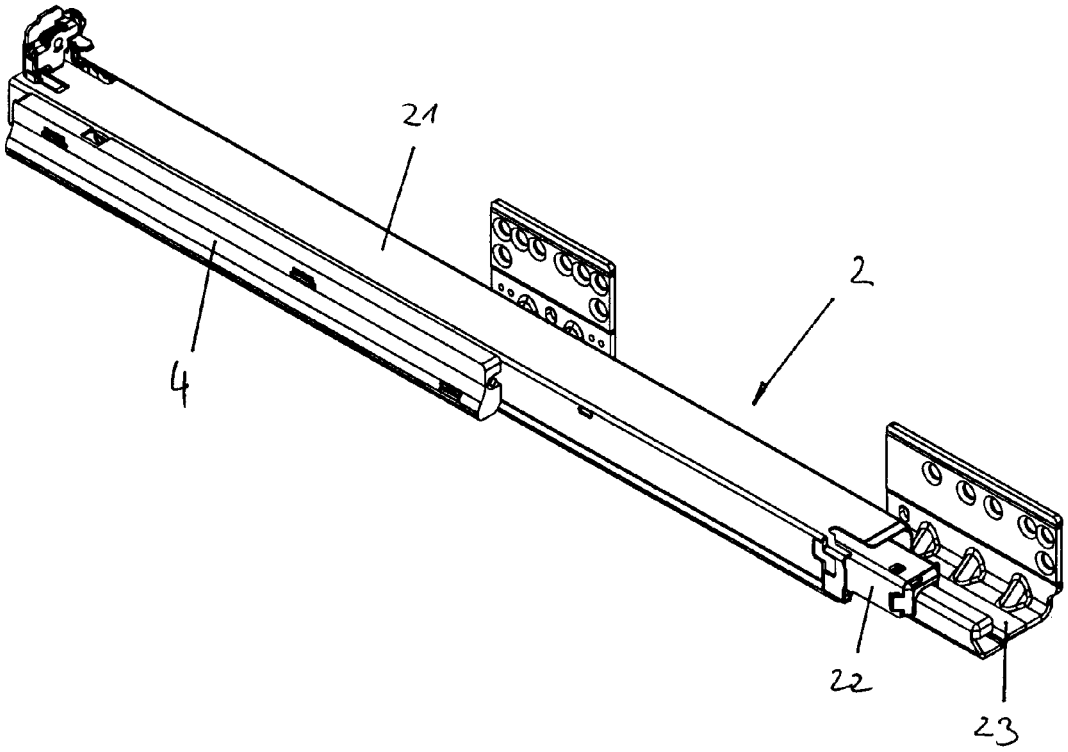
FIG. 6 shows a perspective view of a drawer extension guide with functional unit fixed thereto.

FIG. 6 shows a perspective view of a drawer extension guide 2 (as shown in FIG. 4) and a functional unit 4 arranged thereon (as shown in FIG. 5).

Figure 7A:
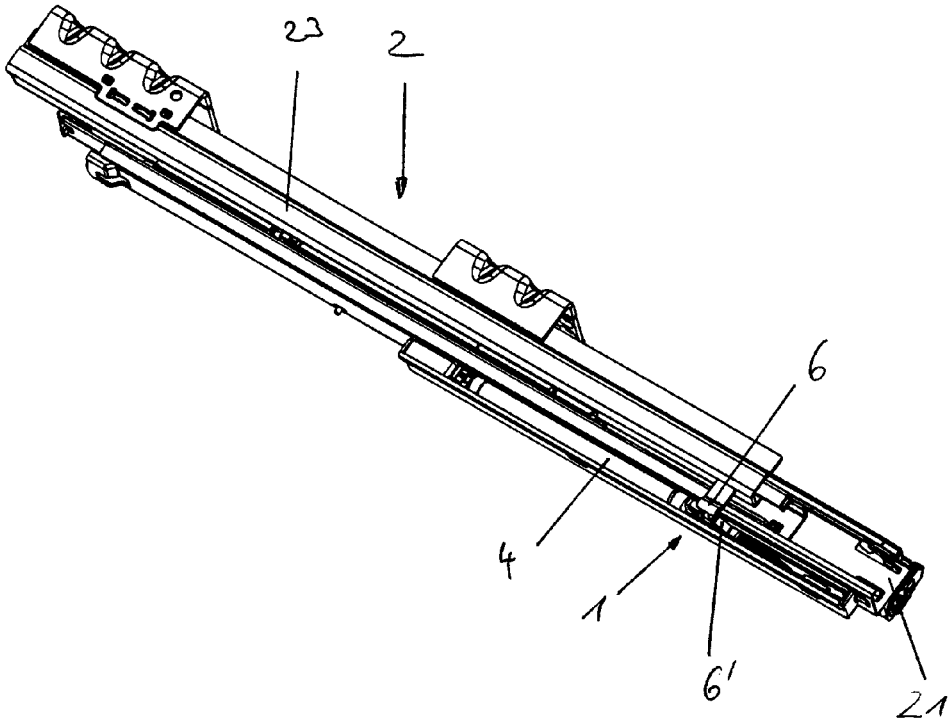
FIG. 7*a* shows a perspective view from below of a drawer extension guide with functional unit arranged thereon.
Figure 7B:
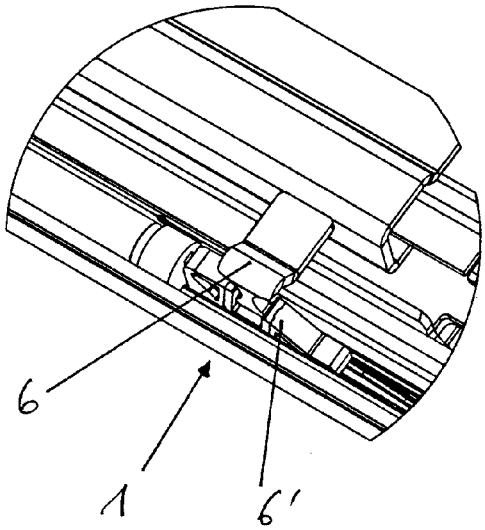
FIG. 7*b* shows a detail view of FIG. 7*a*.

FIGS. 7*a* and 7*b* show a view from below of a drawer extension guide 2 and a functional unit 4 arranged thereon. The functional unit 4 is releasably fixed to the carcass rail 23 of the drawer extension guide 2 by way of the coupling elements 6 and 6' of the attachment device 1 for mounting a functional unit to a rail of the drawer extension guide 2.

Figure 8A:
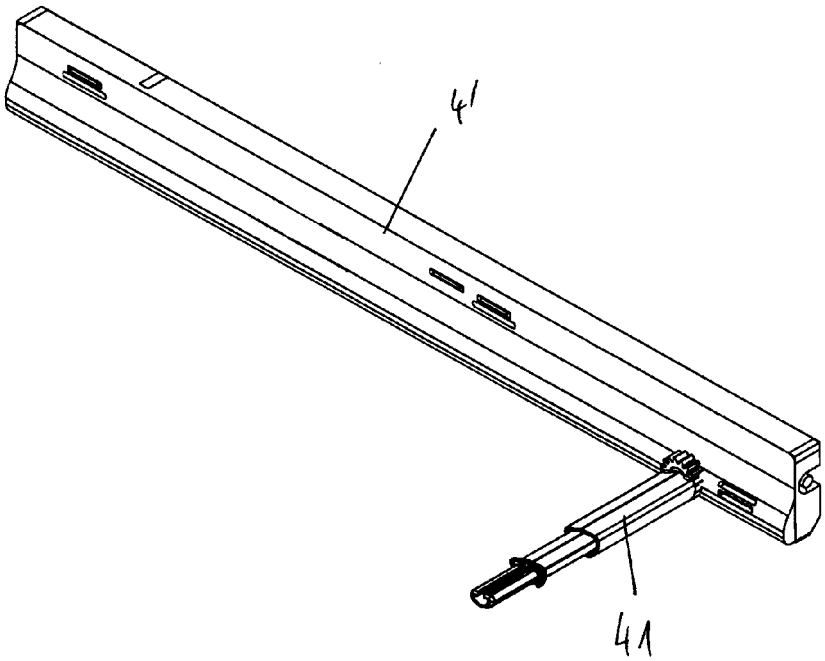
FIG. 8*a* shows a perspective view of a functional unit with a synchronisation device.

FIG. 8*a* shows a perspective view of a further functional unit 4'. In this embodiment, the functional unit 4' has a synchronization device 41 for synchronizing a drawer extension guide with a further drawer extension guide. On the underside—as shown in FIG. 8*b*—this functional unit 4' also has a coupling element 6' and also coupling elements 8 of a device 1, by which the functional unit 4' can be fixed to a rail (not shown) of a drawer extension guide 2.

Figure 8B:
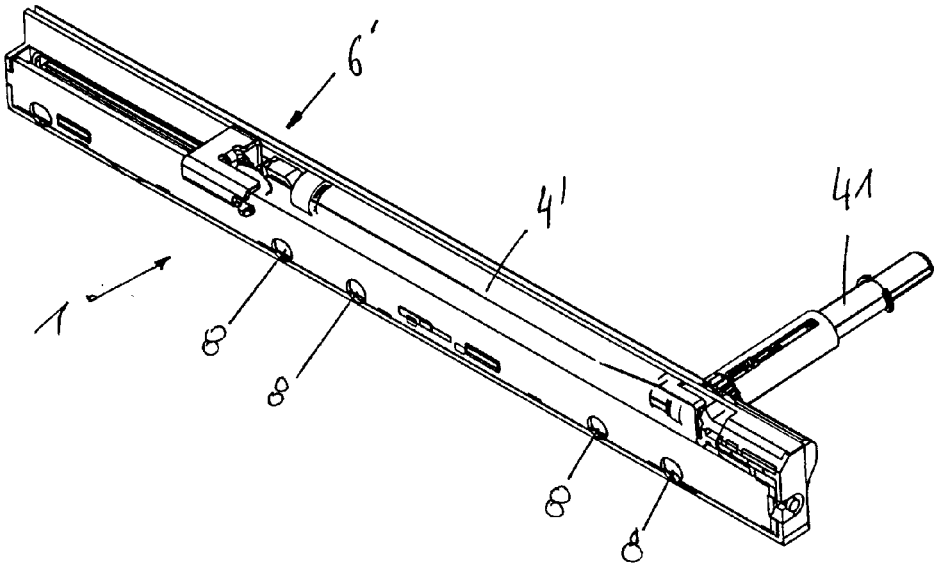
FIG. 8*b* shows a perspective view from below of FIG. 8*a*.
Figure 9:
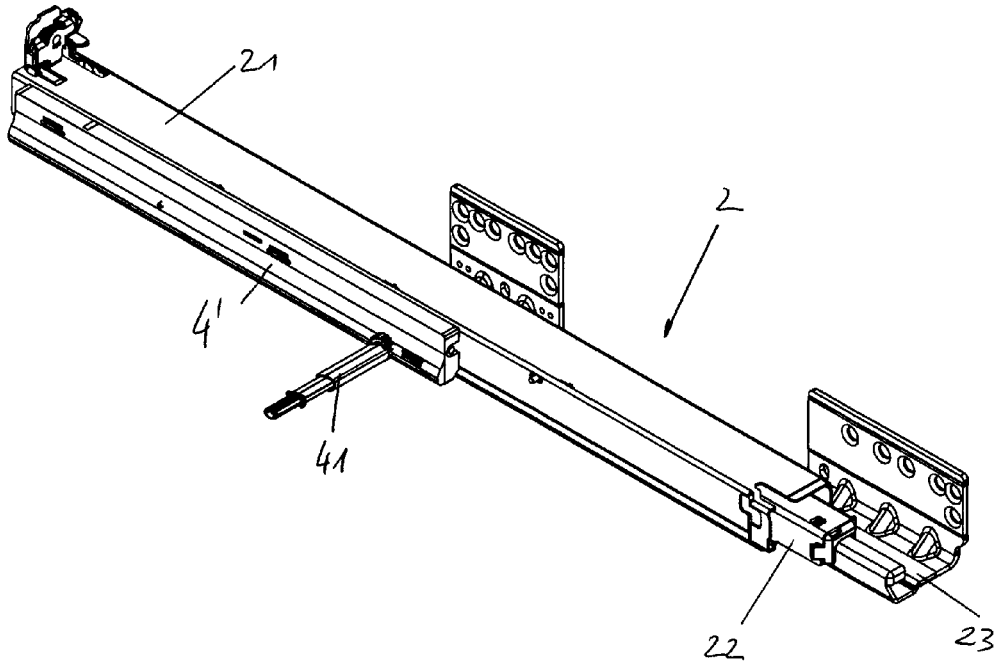
FIG. 9 shows a perspective view of a drawer extension guide with functional unit arranged thereon, with synchronisation device.

FIG. 9 shows a perspective view of the functional unit 4' shown in FIGS. 8*a* and 8*b*, as is connected to a drawer extension guide 2—strictly speaking to its drawer rail 21 and its carcass rail 23—by way of the device 1 (not shown here) and its coupling elements 6, 6', 7 and 8.

Figure 10A:
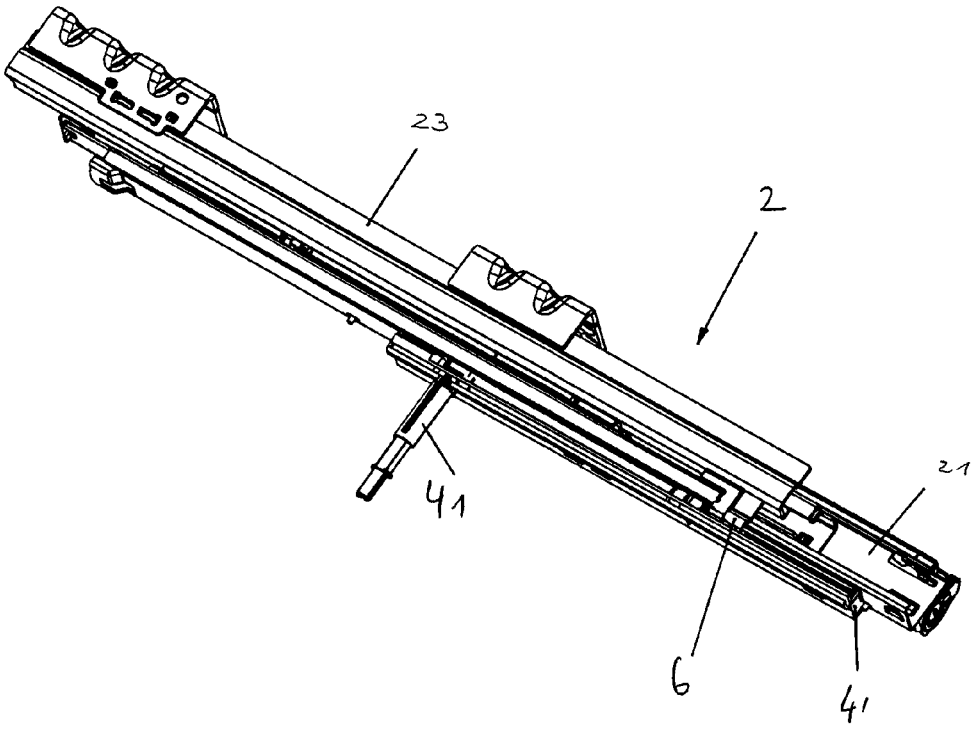
FIG. 10*a* shows a perspective view from below of a drawer extension guide with functional unit arranged thereon, with synchronisation device.
Figure 10B:
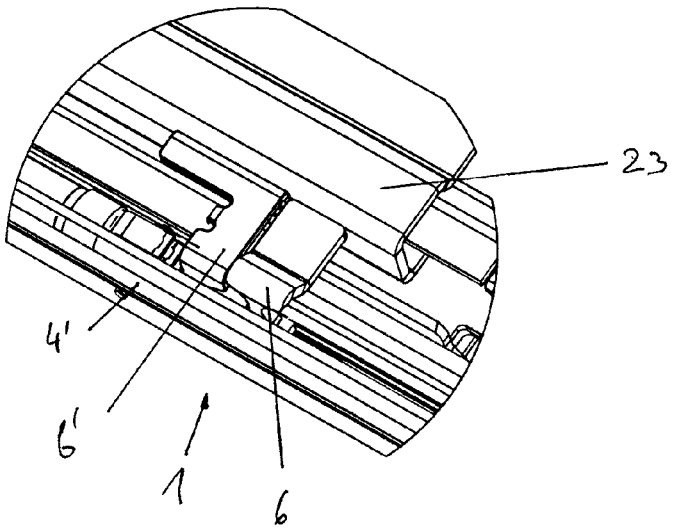
FIG. 10*b* shows a detail view of FIG. 10*a*.

FIGS. 10*a* and 10*b* show an underneath view of the arrangement illustrated in FIG. 9 of a drawer extension guide 2 and a functional unit 4' arranged thereon.

The detail view in FIG. 10*b* shows the two coupling elements 6 and 6' which correspond to each other.

Figure 11:
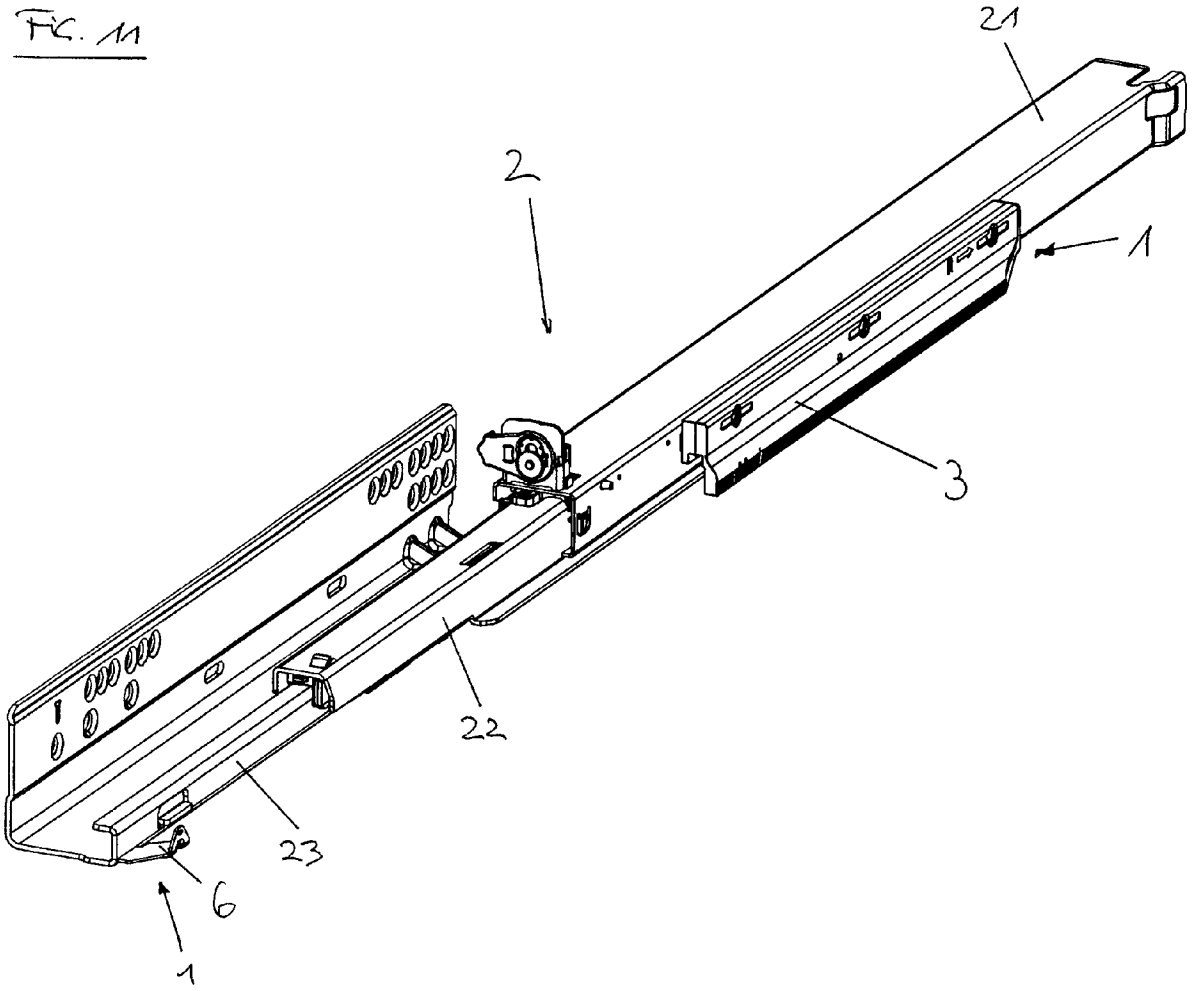
FIG. 11 shows a perspective view of a drawer extension guide in the extended condition.

FIG. 11 shows a perspective view of an extended drawer extension guide 2. In this case, the functional unit 3 is fixed to the drawer rail 21 by the device 1 (by means of the coupling elements 7 and 8 which are not shown here).

The carcass rail 23 has the coupling element 6 which comes into connected relationship with the functional unit 3 when the drawer rail 21 moves in. In that case, the functional unit 3 uses the coupling element 6 to repel itself therefrom and thus can eject a drawer (not shown here) from the article of furniture. When the drawer moves inwardly the coupling element 6 is used as part of a damping device of the functional unit 3. The coupling element 6 has a hooked configuration and can penetrate through beneath the drawer rail 21 into a groove in the functional unit 3 and thus correspond thereto.

In this preferred embodiment, therefore, the device 1 has on the one hand coupling elements 7 and 8 which move jointly with a drawer rail 21. In addition, it has a coupling element 6 which does not move together with the drawer rail 21 but is arranged fixedly on the carcass rail 23.

Figures 12A, 12B:
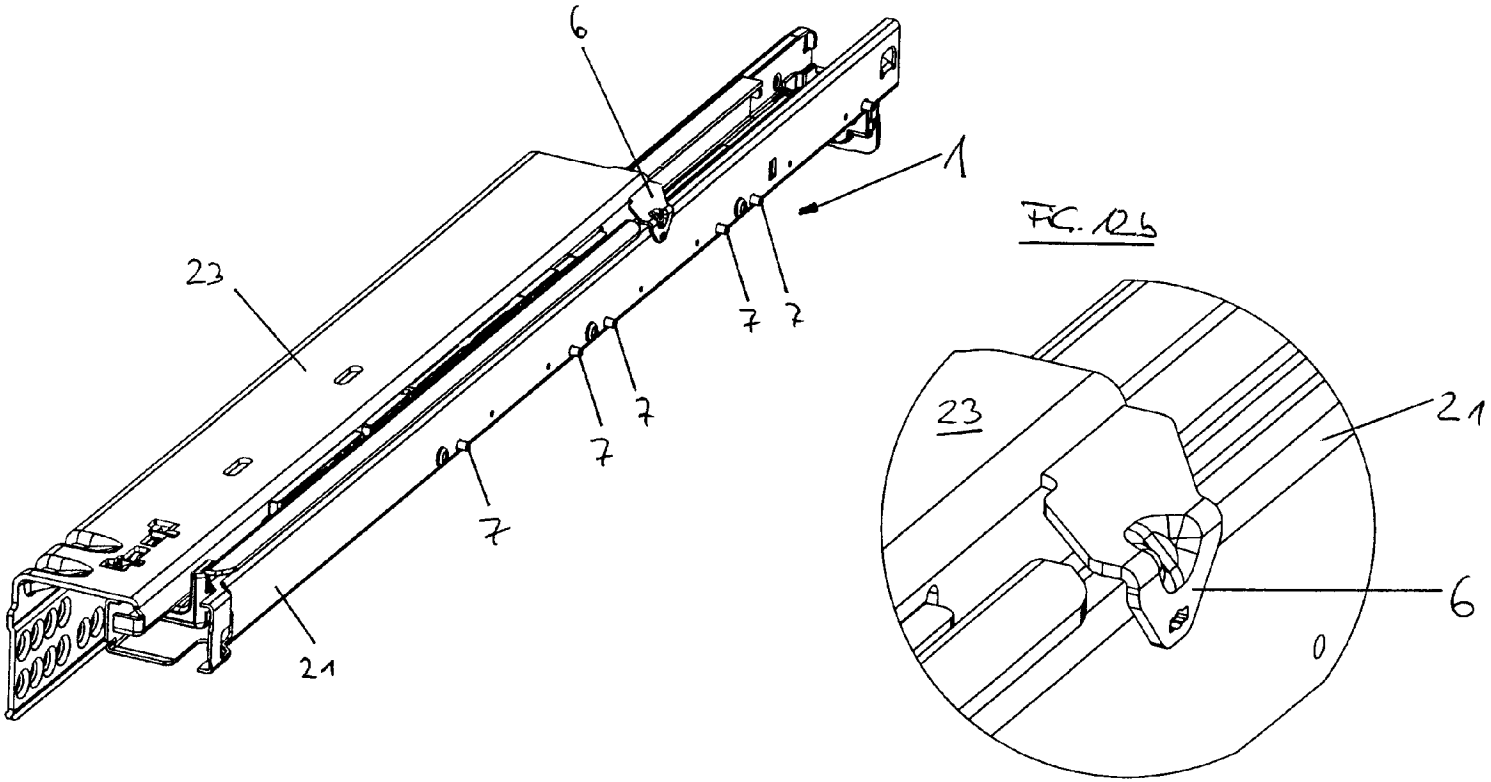
FIG. 12*a* shows a perspective view from below of a drawer extension guide.
FIG. 12*b* shows a detail view of FIG. 12*a*.

It can be clearly seen from FIG. 12*a* how the coupling element 6 extends from the carcass rail 23 beneath the drawer rail 21 (see the detail view in FIG. 12*b*).

Figure 13:
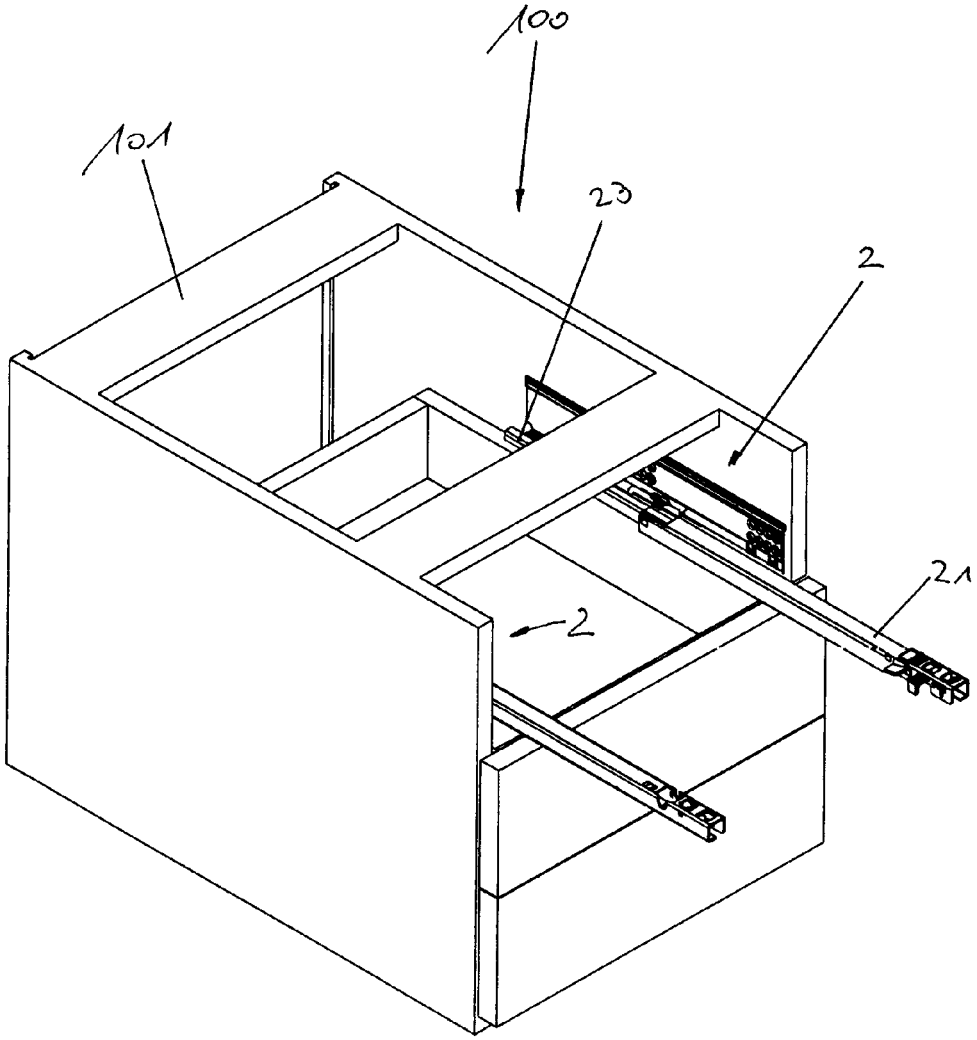
FIG. 13 shows a perspective view of an article of furniture with two drawer extension guides.

FIG. 13 shows an article of furniture 100 with a furniture carcass 101. Two drawer extension guides 2 are arranged on the furniture carcass 101, and the drawer extension guides 2 each have a drawer rail 21 and also a carcass rail 23.

In this case devices 1 (not shown) for mounting functional units 3, 4 or 5 (not shown here) to the drawer rail 21 of the drawer extension guide 2 are respectively provided on the drawer extension guide 2.

The invention claimed is:

1. A drawer extension guide comprising:

a carcass rail to be fixed to a furniture carcass;

a drawer rail mounted so as to be displaceable relative to said carcass rail;

at least two different functional units configured to perform different functions; and an attachment device for attaching said at least two different functional units to said carcass rail and/or to said drawer rail, said attachment device including:

a first coupling element on said drawer rail for selectively, releasably, and interchangeably supporting each of said at least two different functional units at a mounting location; and a second coupling element on said carcass rail for intermittently engaging and coupling to said at least two different functional units.

2. The drawer extension guide of claim 1, wherein said at least two different functional units are configured to be selectively, releasably, and interchangeably fixed by said coupling element to said drawer rail at said mounting location without a tool.

3. The drawer extension guide of claim 1, wherein said coupling element has a latching device.

4. The drawer extension guide of claim 1, wherein said at least two functional units are configured to be fixed by said attachment device to said drawer rail.

5. The drawer extension guide of claim 1, wherein said first coupling element is hook-shaped.

6. The drawer extension guide of claim 1, wherein said attachment device is a discrete unit independent of, and non-integral with, said carcass rail and said drawer rail.

7. The drawer extension guide of claim 1, wherein said attachment device is at least partially located at an underside of said carcass rail and/or at least partially located at a remote side of said carcass rail remote from the furniture carcass.

8. The drawer extension guide of claim 1, wherein said at least two functional units are to be attached by said attachment device at a lateral side of said drawer rail and substantially parallel to said drawer rail at a location remote from the furniture carcass.

9. The drawer extension guide of claim 1, wherein said at least two functional units include an ejection device for ejecting said drawer rail from a closed end position to an open position.

10. The drawer extension guide of claim 1, wherein said at least two functional units includes:

a retraction device for pulling said drawer rail towards a closed end and into a completely closed position; and/or a damping device for damping a movement of said drawer rail.

11. The drawer extension guide of claim 1, wherein said at least two functional units are both simultaneously fixed by said first coupling element to said drawer rail.

12. The drawer extension guide of claim 1, wherein each of said at least two functional units has a third coupling element, at least one of said at least two functional units having a spring-loaded third coupling element.

13. The drawer extension guide of claim 12, wherein said third coupling element of at least one of said at least two functional units is configured to intermittently couple to and/or bear against said first coupling element upon movement of said drawer rail and said carcass rail relative to each other.

14. The drawer extension guide of claim 12, wherein said at least two functional units are configured to be selectively, releasably, and interchangeably fixed by said attachment device to said drawer rail so as to move together with said drawer rail, said third coupling element of at least one of said at least two functional units is configured to move together with said drawer rail, and said first coupling element is stationary relative to said at least two functional units.

15. An article of furniture comprising:

a furniture carcass; and said drawer extension guide of claim 1, said carcass rail of said drawer extension guide being mounted to said furniture carcass.

* * * * *